US006065648A

United States Patent [19]

Tauber

[11] Patent Number: 6,065,648

[45] Date of Patent: May 23, 2000

[54] CHILD RESISTANT DISPENSER

[75] Inventor: John Tauber, Baltimore, Md.

[73] Assignee: Poly-Seal Corporation, Baltimore, Md.

[21] Appl. No.: 09/342,244

[22] Filed: Jun. 29, 1999

[51] Int. Cl.[7] ..... B67D 5/33

[52] U.S. Cl. ..... 222/153.14; 222/521

[58] Field of Search ..... 222/153.14, 520, 222/521

[56] References Cited

U.S. PATENT DOCUMENTS

| | | | |
|---|---|---|---|
| 4,690,304 | 9/1987 | Morel | 222/153.14 |
| 4,967,941 | 11/1990 | Beck | 222/521 |
| 5,090,598 | 2/1992 | Stull | 222/520 |
| 5,715,977 | 2/1998 | Goncalves | 222/521 |

*Primary Examiner*—Philippe Derakshani

*Attorney, Agent, or Firm*—Dickstein Shapiro Morin & Oshinsky LLP

[57] ABSTRACT

A child resistant dispenser including an outer shell and an inner shell which are fixedly attached to and non-removable from a container. The outer shell includes an orifice in fluid connection with the container, and the inner shell includes a seal peg for obstructing the orifice when the dispenser is in the closed position. The dispenser includes a plurality of lugs which fit within and are movable along a plurality of sloped races. The races may include two or more portions having differing slopes. The inner and outer shells include a plurality of latches which are engageable and disengageable with each other. An inwardly directed force on at least one pressure point allows for disengagement of the latches and permits rotation of the outer shell, allowing the outer shell to move axially relative to the inner shell, thereby unplugging the orifice. Rotation in the opposite direction will move the outer shell axially downward, thereby replugging the orifice.

23 Claims, 22 Drawing Sheets

CHILD RESISTANT DISPENSER

BACKGROUND

The present invention relates dispensers which dispense liquids or powders and more particularly to dispensers having dispensing caps secured to the dispensing containers and having child resistant mechanisms to prevent unauthorized opening of the dispensing orifice.

Dispensers which are affixed to containers containing liquids or powders have become widely used for mixing dispensing the entrained materials. Such dispensers should be easy to manipulate into an opened and a closed position, while including safety features to prevent unauthorized opening and dispensing of materials, such as by children. Some known dispensers include caps which are removable, thereby lessening the safety aspect of such dispensers. Examples of such known dispensers are described in U.S. Pat. Nos. 5,735,417 and 4,358,031. U.S. Pat. No. 5,735,417 (Darr et al.) is directed to a container closure locking assembly including a cap which is removable from the container. U.S. Pat. No. 4,358,031 (Lohrman) is directed to a safety closure and container having a dispensing spout. The cap is threadably attached, and thus, removable.

There remains a need for a dispensing cap which is child resistant and is easily manipulated to an opened and a closed position.

SUMMARY OF THE INVENTION

In accordance with a preferred embodiment of the present invention, a dispenser is provided having an outer shell and an inner shell. The outer shell includes a top portion having a spout with an orifice extending therethrough, a side portion having an inner surface on which at least one latch is located, an interior side portion with an inner surface on which at least one sloping race is located, and a seal peg receiver. The inner shell includes a seal peg, a top portion, and a side portion having at least one lug, at least one stop, and an inner surface sized and shaped to receive a neck of a container. The seal peg is movably received within the seal peg receiver, at least one lug is movably received within the at least one race, and the at least one latch and the at least one stop are sized and positioned to engage each other and to permit rotatable opening and closing of the dispenser.

In one aspect of the invention, the sloping races include two or more portions, each with a different slope.

In another aspect of the invention, a pair of tabs are included on the outer shell side portion, and an inwardly directed force on each tab disengages the latches from the stops. A counter-clockwise rotation of the outer shell moves the lugs along the races and axially moves the orifice away from the seal peg to open the dispenser. A clockwise rotation of the outer shell moves the lugs along the races, axially moves the orifice toward the seal peg, and engages the latches with the stops, thereby closing the dispenser.

In a second preferred embodiment of the invention, a dispenser is provided having an outer shell and an inner shell. The outer shell includes a top portion with an orifice extending therethrough, a side portion having an inner surface with at least one latch is located on it, an interior side portion having an inner surface, with at least one sloping race located on it, and a seal peg receiver. The inner shell includes a seal peg, a top portion, a side portion having at least one lug and an inner surface sized and shaped to receive a neck of a container, and a base portion having a pair of finger tabs and a pair of latches. The seal peg is movably received within the seal peg receiver, the at least one lug is movably received within the at least one race, and the base portion latches are engageable and disengageable with the outer shell latches to permit rotatable opening and closing of the dispenser.

In one aspect of the invention, the sloping races include two or more portions, each with a different slope.

In another aspect of the invention, a radially inwardly directed force exerted on the tabs enables disengagement of the base portion latches from the outer shell latches. While the base portion latches arc disengaged from the outer shell latches, a counter-clockwise rotation of the outer shell moves the lugs along the races and axially moves the orifice away from the seal peg to open the dispenser. A clockwise rotation of the outer shell moves the lugs along the races, axially moves the orifice toward the seal peg, and engages the base portion latches with the outer shell latches, thereby closing the dispenser.

In a third preferred embodiment of the invention, a dispenser is provided having an outer shell and an inner shell. The outer shell includes a top portion with an orifice extending therethrough, a side portion having a flexible thumb tab and an inner surface with at least one sloping race located on it, and a seal peg receiver. The inner shell includes a seal peg, a top portion, a side portion having at least one lug and an inner surface sized and shaped to receive a neck of a container, and a base portion having a latch. The seal peg is movably received within the seal peg receiver, the at least one lug is movably received within the at least one race, and the base portion latch is engageable and disengageable with the thumb tab to permit rotatable opening and closing of the dispenser.

In an aspect of the invention, the sloping races include two or more portions, each with a different slope.

In another aspect of the invention, a radially inwardly directed force exerted on the tab enables disengagement of the base portion latch from the tab. While the base portion latch is disengaged from the tab, a counter-clockwise rotation of the outer shell moves the lugs along the races and axially moves the orifice away from the seal peg to open the dispenser. A clockwise rotation of the outer shell moves the lugs along the races, axially moves the seal peg toward the orifice, and engages the base portion latch with the tab, thereby closing the dispenser.

DETAILED DESCRIPTION OF PREFERRED EMBODIMENTS

Figure 1:
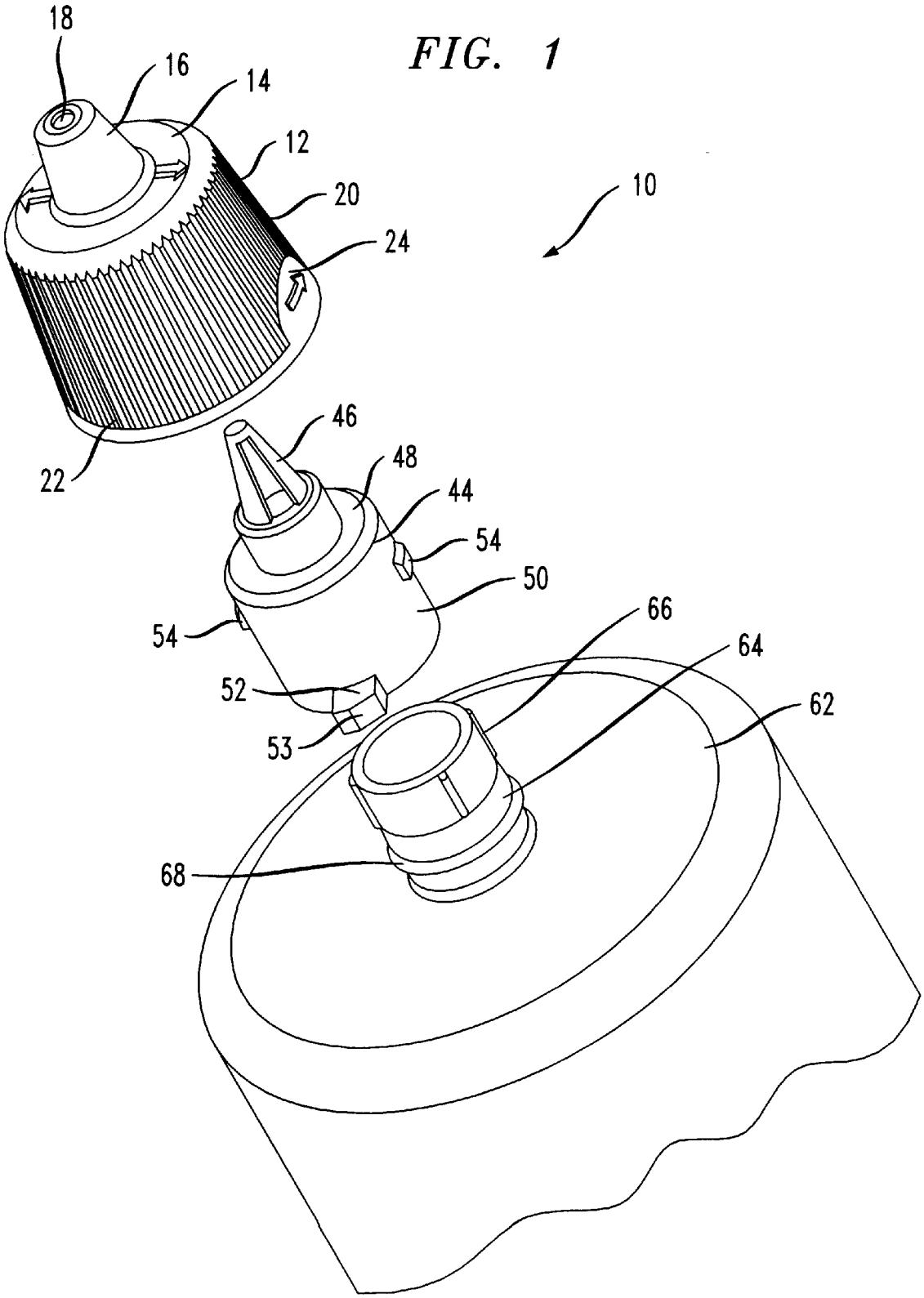
FIG. 1 is an exploded perspective view of a child resistant dispenser constructed in accordance with a preferred embodiment of the invention.

Referring now to FIGS. 1–8, a child resistant dispenser 10 according to a preferred embodiment of the invention is shown. The dispenser 10 includes an outer shell 12 and an inner shell 44. The outer shell 12 is generally cylindrical, having a side portion 20 and a top portion 14. Extending axially from the top portion 14 is a spout 16 having a spout orifice 18. Extending around the circumference of the side portion 20 are axially aligned ridges 22. The ridges 22 assist in one's ability to grip and rotate the outer shell 12 (described in greater detail below). A pair of finger tabs 24 are positioned at a lower extent of the side portion 20. Each tab 24 is positioned opposite the other tab 24, approximately 180 degrees apart.

Figure 2:
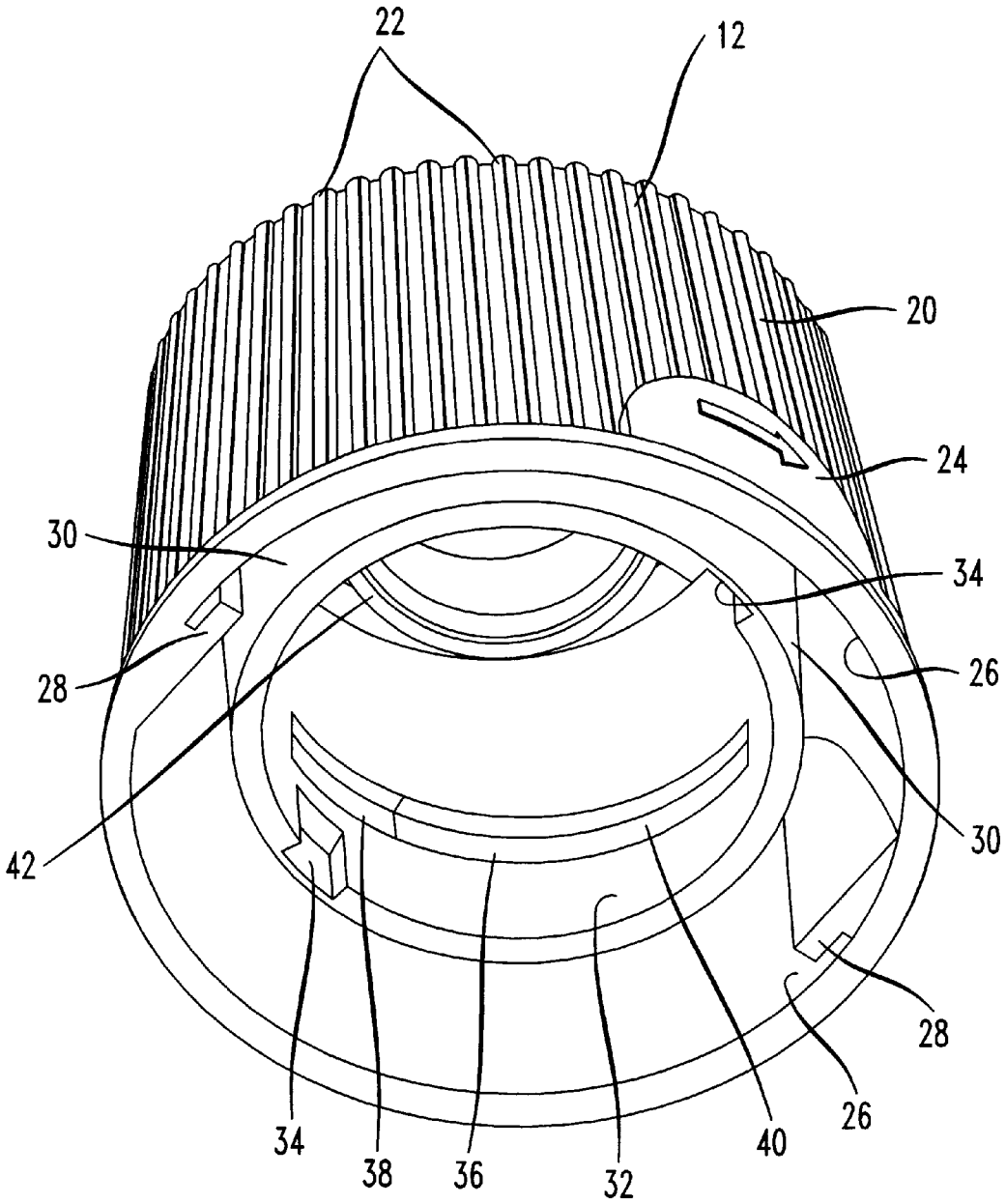
FIG. 2 is a perspective view of the outer shell of the dispenser of FIG. 1.

Referring to FIG. 2, the side portion 20 has an inner surface 26. Spaced interior to and apart from the inner surface 26 is an internal side portion 30. The internal side portion 30, generally cylindrical in shape and encircled by the side portion 20, itself encircles a seal peg receiver 42. Located on inner surface 26 are a pair of latches 28. Each latch 28 is opposite from the other latch 28, positioned approximately 180 degrees apart and approximately 90 degrees (a quarter turn) from each of the finger tabs 24.

Figure 3:
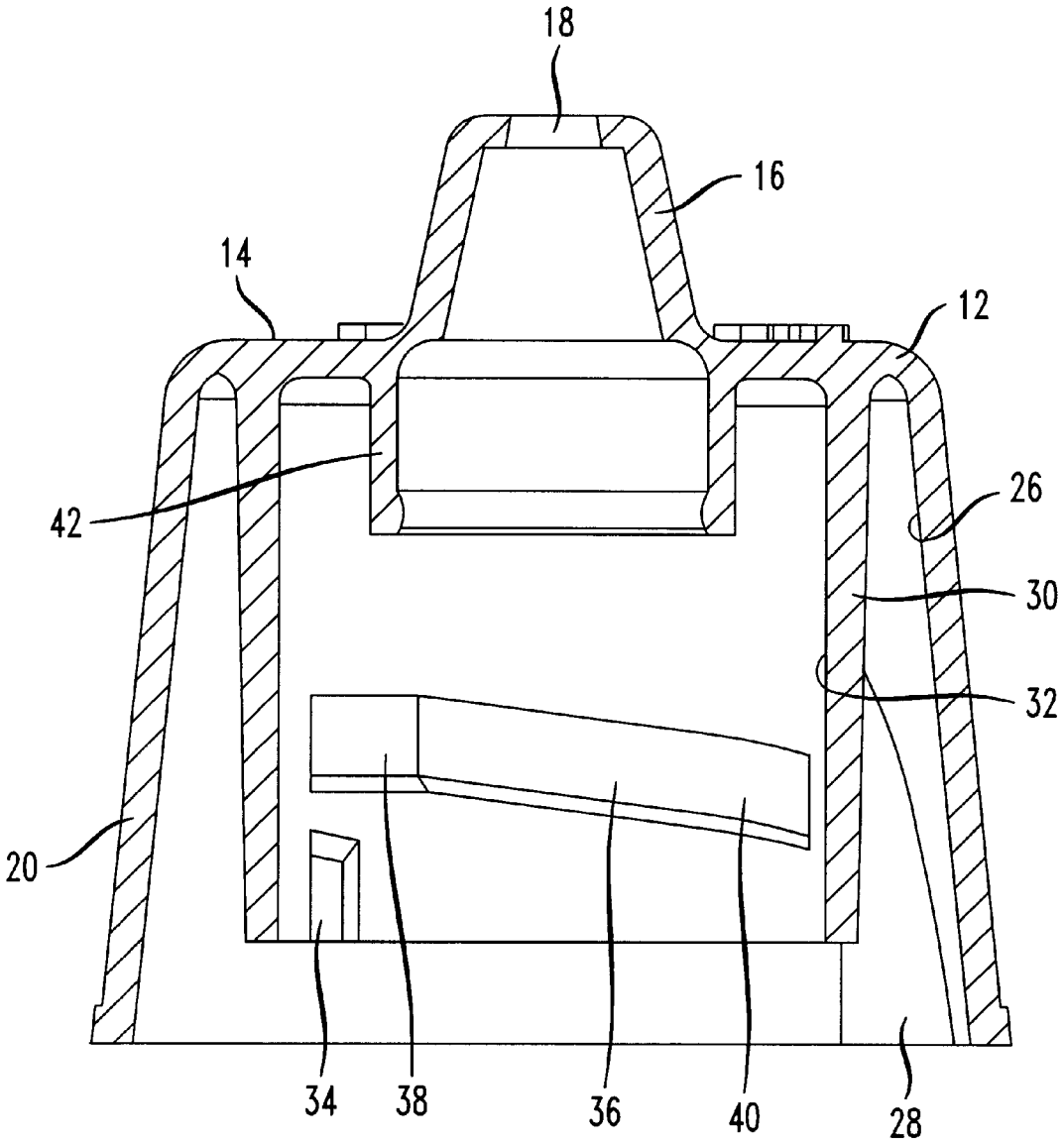
FIG. 3 is a cross-sectional view of the outer shell of the dispenser of FIG. 1.

The internal side portion 30 has an inner surface 32. Two or more notches 34 are located on the inner surface 32. The notches 34 are aligned with two or more inner races 36 and positioned generally interior to the finger tabs 24. The notches 34 function to aid in the location and assembly of inner shell 44. The inner surface 32 of the internal side portion 30 further includes a pair of sloping races 36. The races 36 face one another on the inner surface 32 of the internal side portion 30. As illustrated in FIGS. 2, 3, the races 36 include a first portion 38 and a second portion 40. The first portion 38, as shown in FIG. 3, has virtually no slope, while the second portion 40 slopes downwardly away from the first portion 38. Alternatively, the races 36 may include a single portion having a singular slope.

Figure 4:
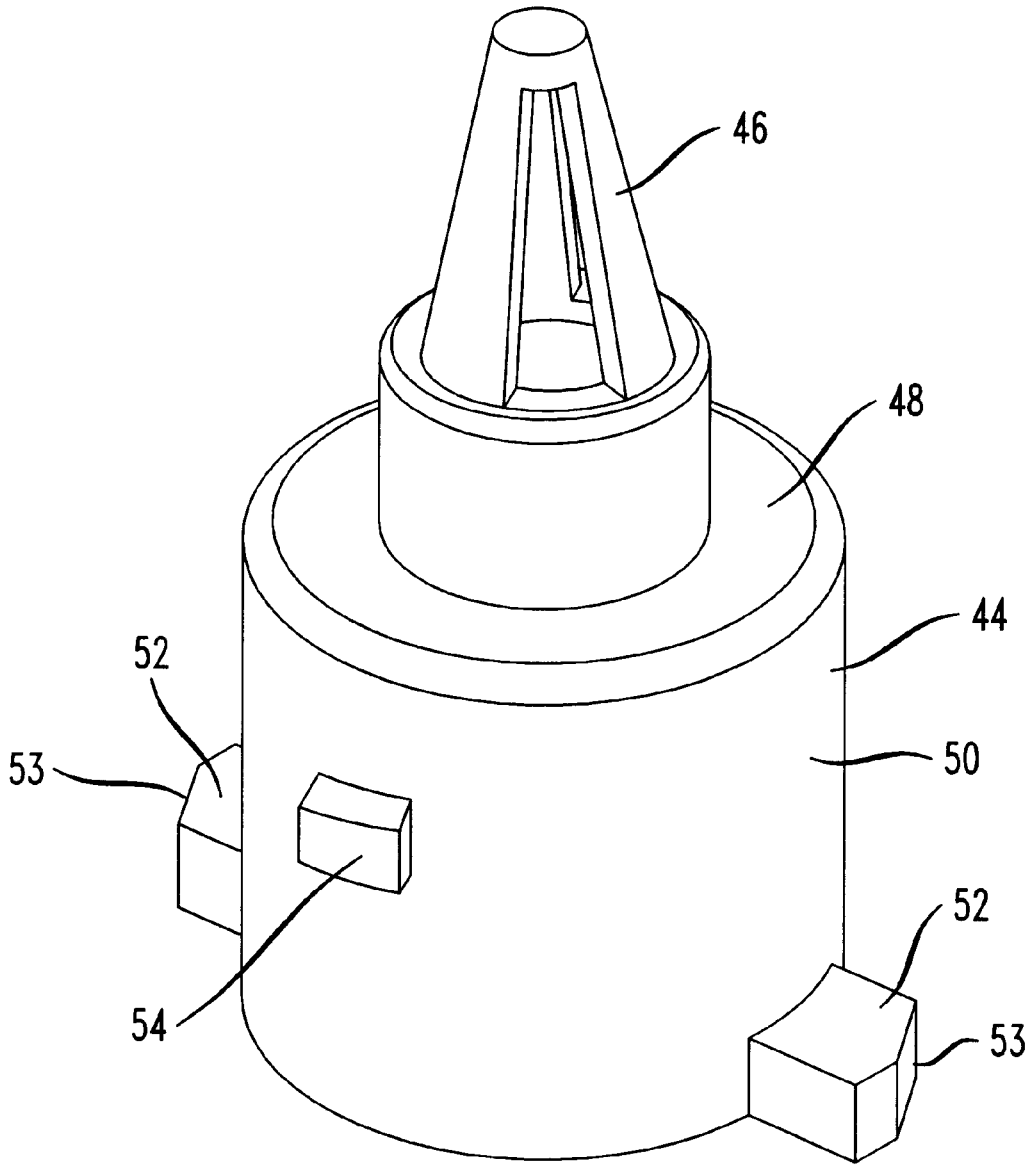
FIG. 4 is a perspective view of the inner shell of the dispenser of FIG. 1.
Figure 5:
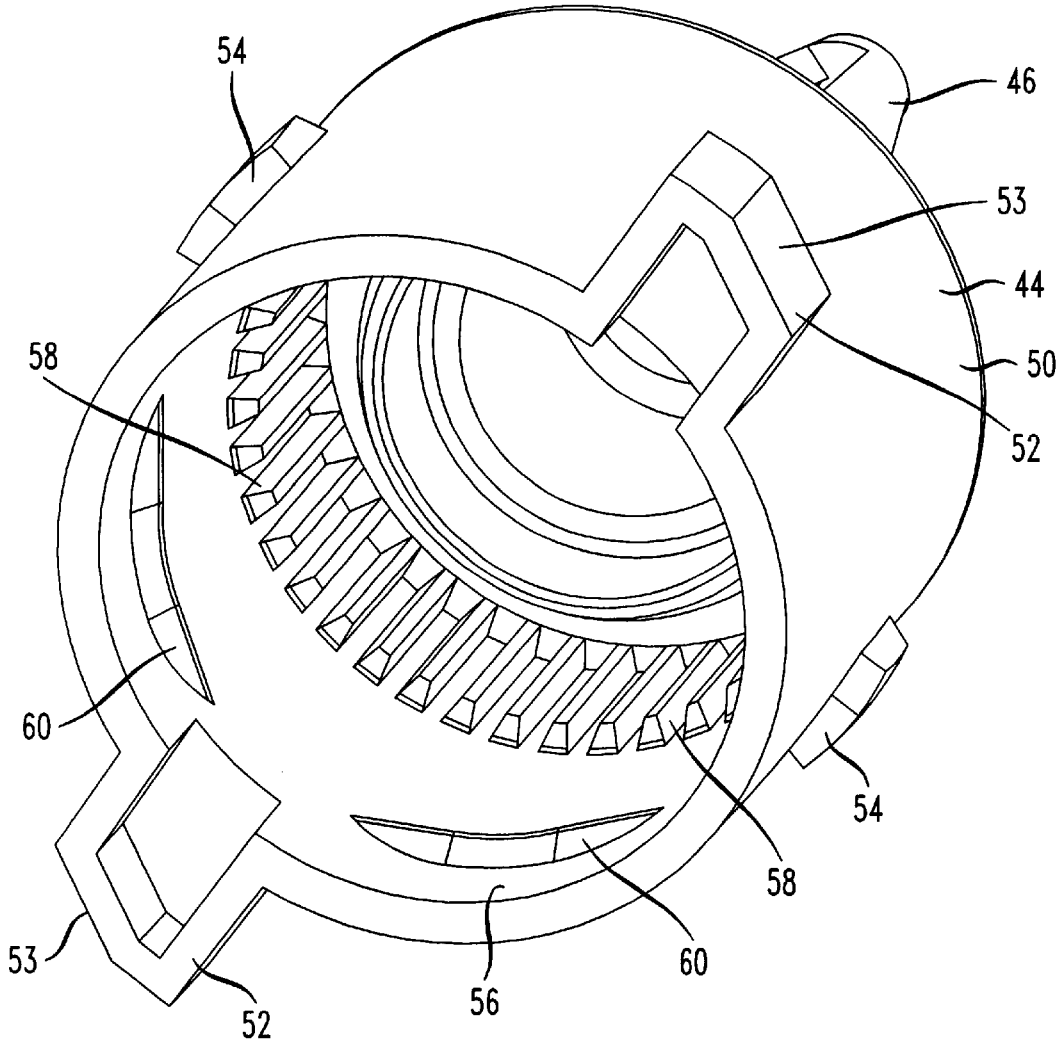
FIG. 5 is another perspective view of the inner shell of the dispenser of FIG. 1.

With reference to FIGS. 1, 4, 5, the inner shell 44 includes a seal peg 46, extending axially upward from a top portion 48, and a side portion 50. A pair of stops 52 are located at a lower extent of the side portion 50. The stops 52 include a sloped portion 53. The stops 52 are each positioned approximately 180 degrees from each other. The side portion 50 also includes two or more lugs 54. The lugs 54 are equally spread from one another. The lugs 54 are sized, shaped and positioned to fit within and be movable along the races 36. The provision of races 36 and lugs 54 provides the vertical movement of the outer shell 12 when rotated during opening and/or closing of the dispenser 10.

With specific reference to FIG. 5, the side portion 50 includes an inner surface 56. A plurality of axially aligned ridges 58 extend circumferentially along the inner surface 56. Further, a plurality of bumps 60 are positioned at a lower extent of the inner surface 56 under the ridges 58.

Figure 6:
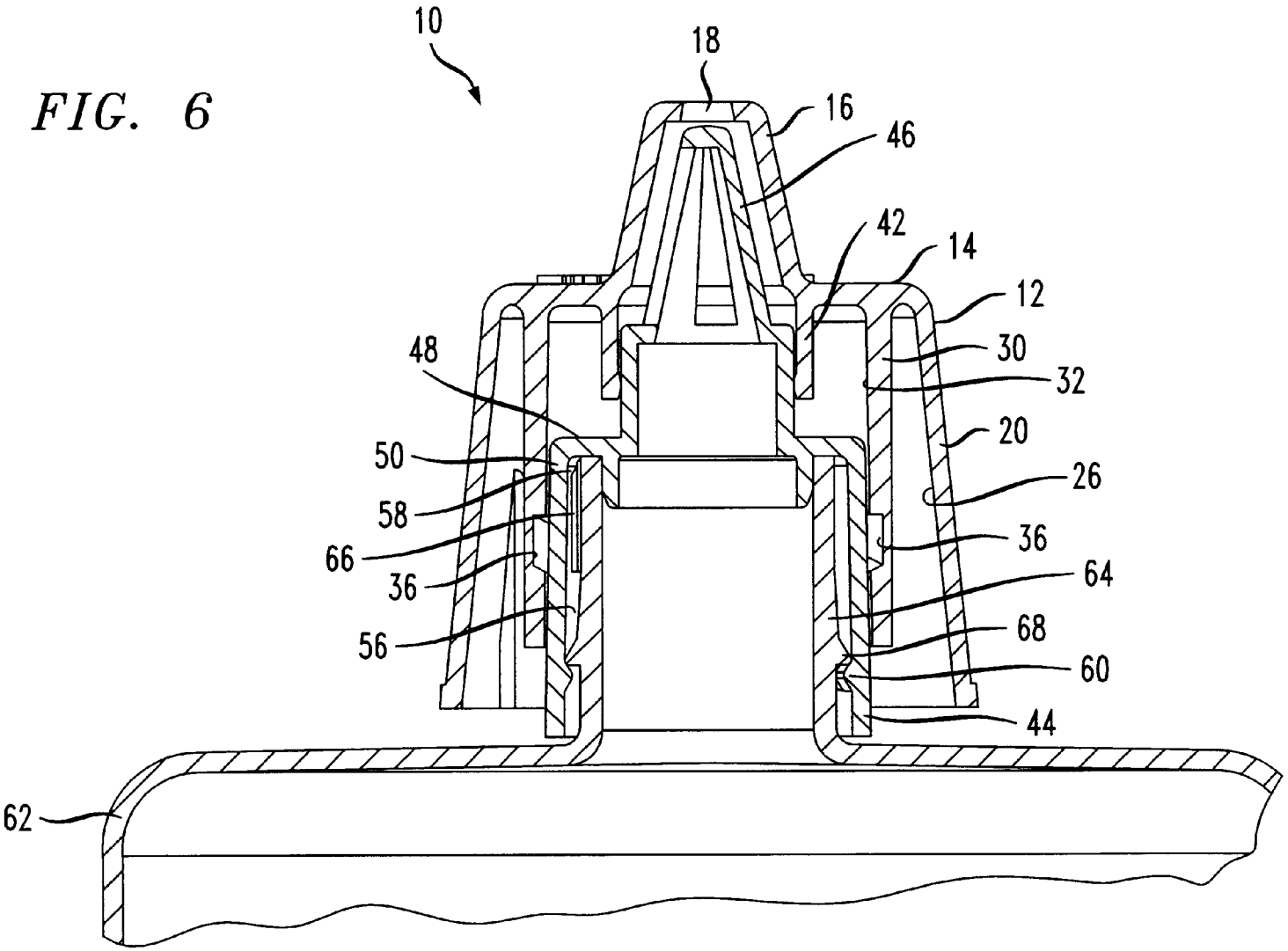
FIG. 6 is a cross-sectional view of the assembled dispenser of FIG. 1 in the opened position.

With reference to FIGS. 1, 6, the inner shell 44 is placed over a container neck 64 of a container 62. The container neck 64 includes a plurality of axially aligned ridges 66 as well as a lip 68 extending circumferentially around the container neck 64.

When assembled, and in the opened position (FIG. 6), the seal peg 46 is positioned within the spout 16 such that the spout orifice 18 is unblocked by the tip of the seal peg 46. The orifice 18 is in fluid connection with the container 62 to allow for enclosed materials to be dispensed.

Each of the lugs 54 is positioned within one of the sloping races 36. Also, the container neck ridges 66 mesh with the inner shell ridges 58. Finally, the bumps 60 are positioned adjacent to the lip 68. The meshing of the ridges 66 with the ridges 58 assists in securing the inner and outer shells 44, 12 from rotating about the container neck 64. The bumps 60 secure the inner and outer shells 44, 12 to the bottle lip 68 by snapping over the lip 68 when assembled.

Figure 7:
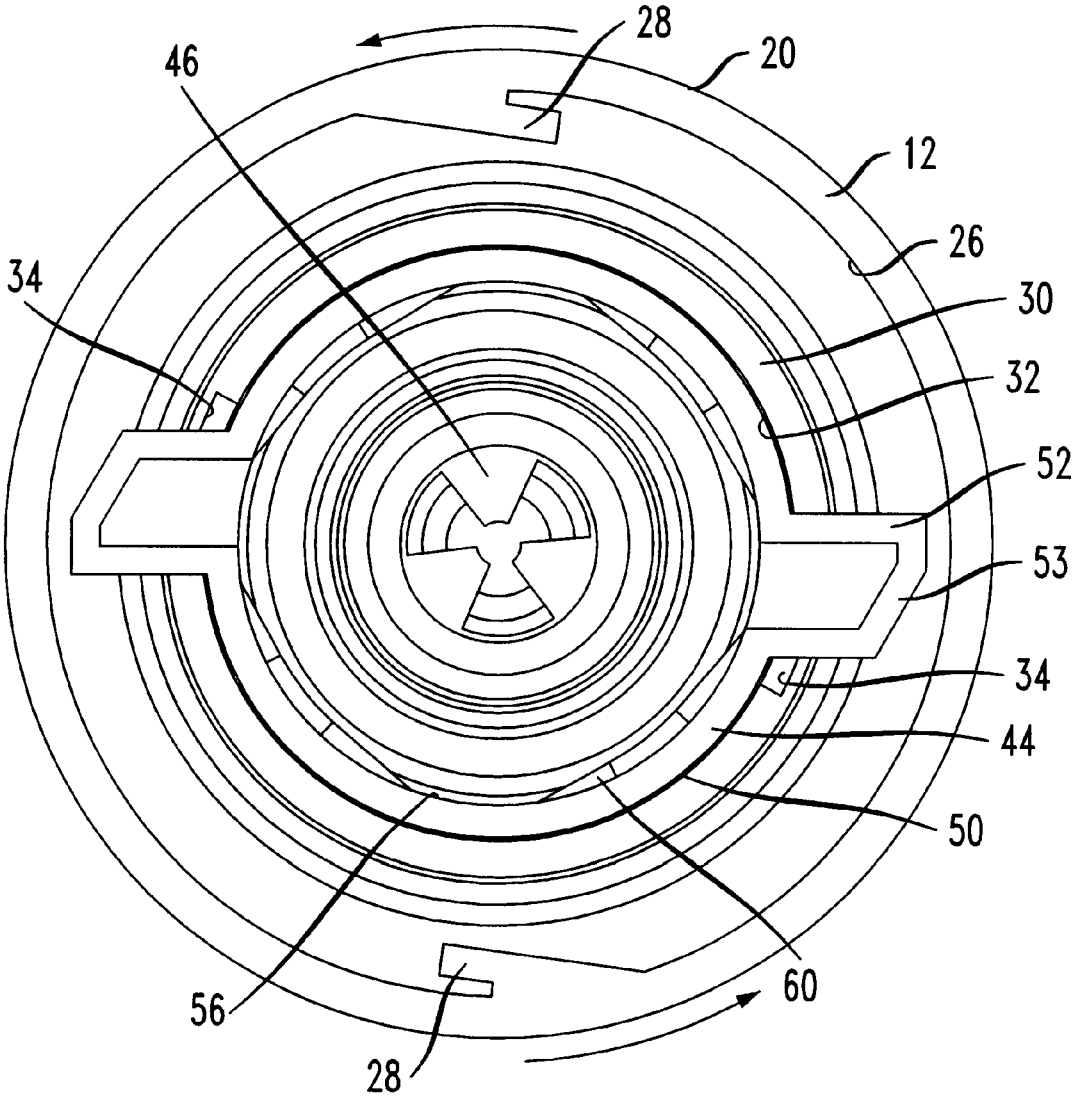
FIG. 7 is a view from the container looking upward of the dispenser of FIG. 1 in the opened position.
Figure 8:
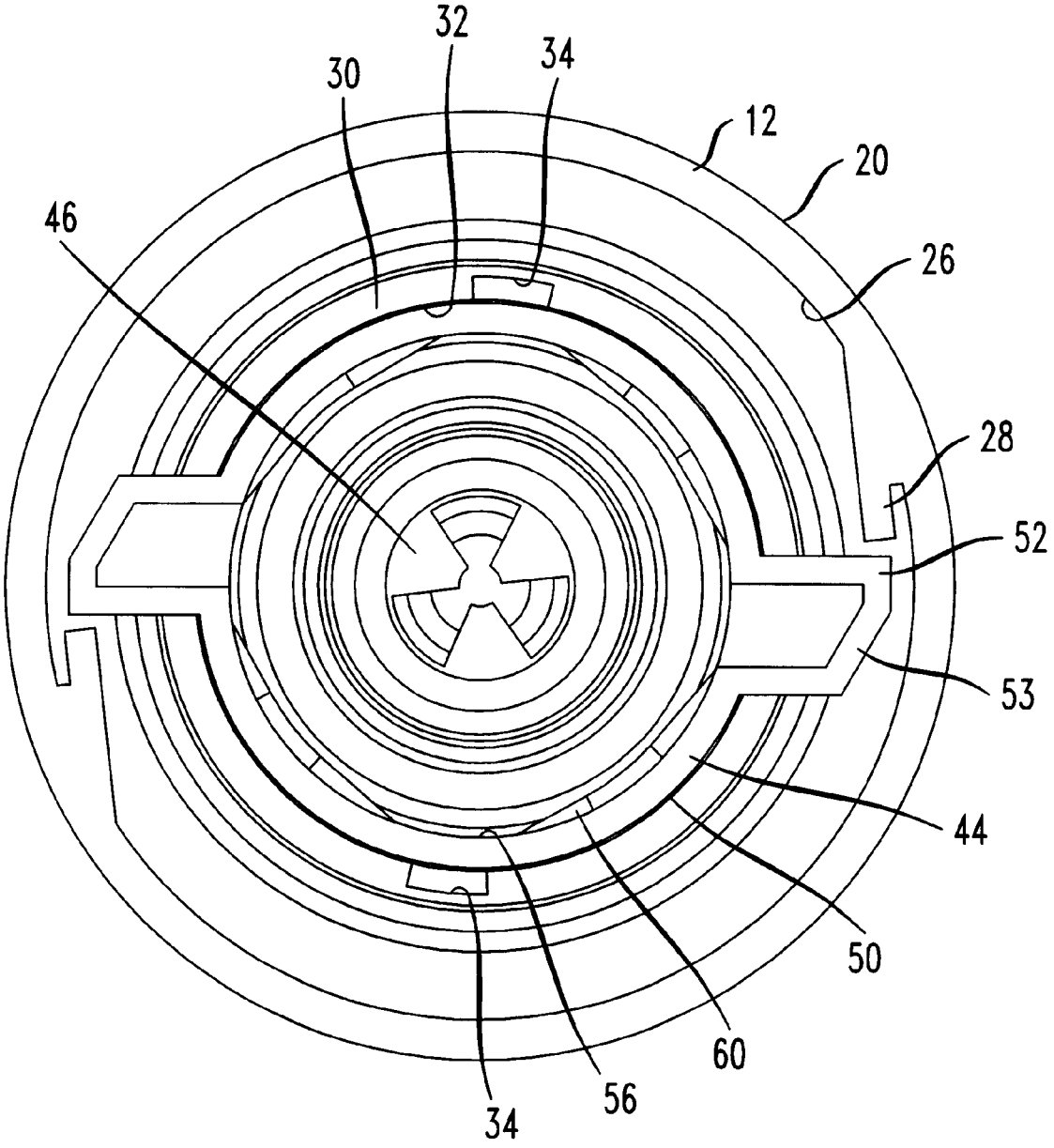
FIG. 8 is a view from the container looking upward of the dispenser of FIG. 1 in the closed position.

With specific reference to FIGS. 2, 7, 8, next will be described the method for opening and closing the dispenser 10. As shown in FIG. 7, the stops 52 are positioned approximately a quarter of a turn (about 90 degrees) from each of the latches 28 when the dispenser 10 is in the opened position. Further, although not shown, each of the lugs 54 is at the lowest extent of the second portion 40 of the race 36 when the dispenser 10 is in the opened position. A clockwise turn of the outer shell 12 causes the latches 28 to move into contact with the sloped portions 53 of the stops 52. Further turning the outer shell 12 in a clockwise direction will enable the latches 28 to slide along the sloped portions 53 and to rotate beyond the stops 52 into a closed, or locked, position as shown in FIG. 8. Concurrently, the lugs 54 move up the race 36 and eventually stop in the first portion 38 when the dispenser 10 is in the closed position. Please note that FIGS. 7 and 8 are views from the bottom of the container 62 looking upward, and thus the arrows shown for closing the dispenser 10 are in the counter-clockwise direction. From an upper viewpoint, the outer shell 12 is rotated in the clockwise direction to close the dispenser 10.

In order to open the dispenser 10, it will be necessary to move the latches 28 beyond the stops 52. This may be accomplished by manually pressing inwardly at the finger tabs 24. Exerting two diametrically opposed forces at the finger tabs 24 will elastically deform the outer shell 12 such that the outer shell 12 will become somewhat oval in shape, with both latches 28 being at the long ends of the oval. This deformation will have the effect of expanding the outer shell 12 in the general location of the latches 28 sufficiently to allow one to turn the outer shell 12 in a counter-clockwise direction. This will allow the latches 28 to move beyond the stops 52. As the outer shell 12 is rotated in a counter-clockwise direction, the lugs 54, which were in the first portion 38 of each of the races 36, move from the first portion 38 into the second portion 40. As the lugs 54 move downwardly along the slope of the second portion 40, the outer shell 12 moves axially upwardly relative to the inner shell 44. This has the effect of unblocking the seal peg 46 from the spout orifice 18. In this manner, the dispenser 10 is opened.

With reference to FIGS. 9–15, a dispenser 100 according to another preferred embodiment of the invention is shown. The dispenser 100 includes an outer shell 102 and an inner shell 130. The outer shell 102 is generally cylindrical in shape and includes a top portion 104 and side portion 106. An orifice 108 extends through the top portion 104. The side portion 106 includes an inner surface 110. With specific reference to FIG. 10, a pair of latches 112 are located on the inner surface 110. Each latch 112 includes a sloped surface 113. The latches 112 are approximately 180 degrees apart from one another.

Figure 10:
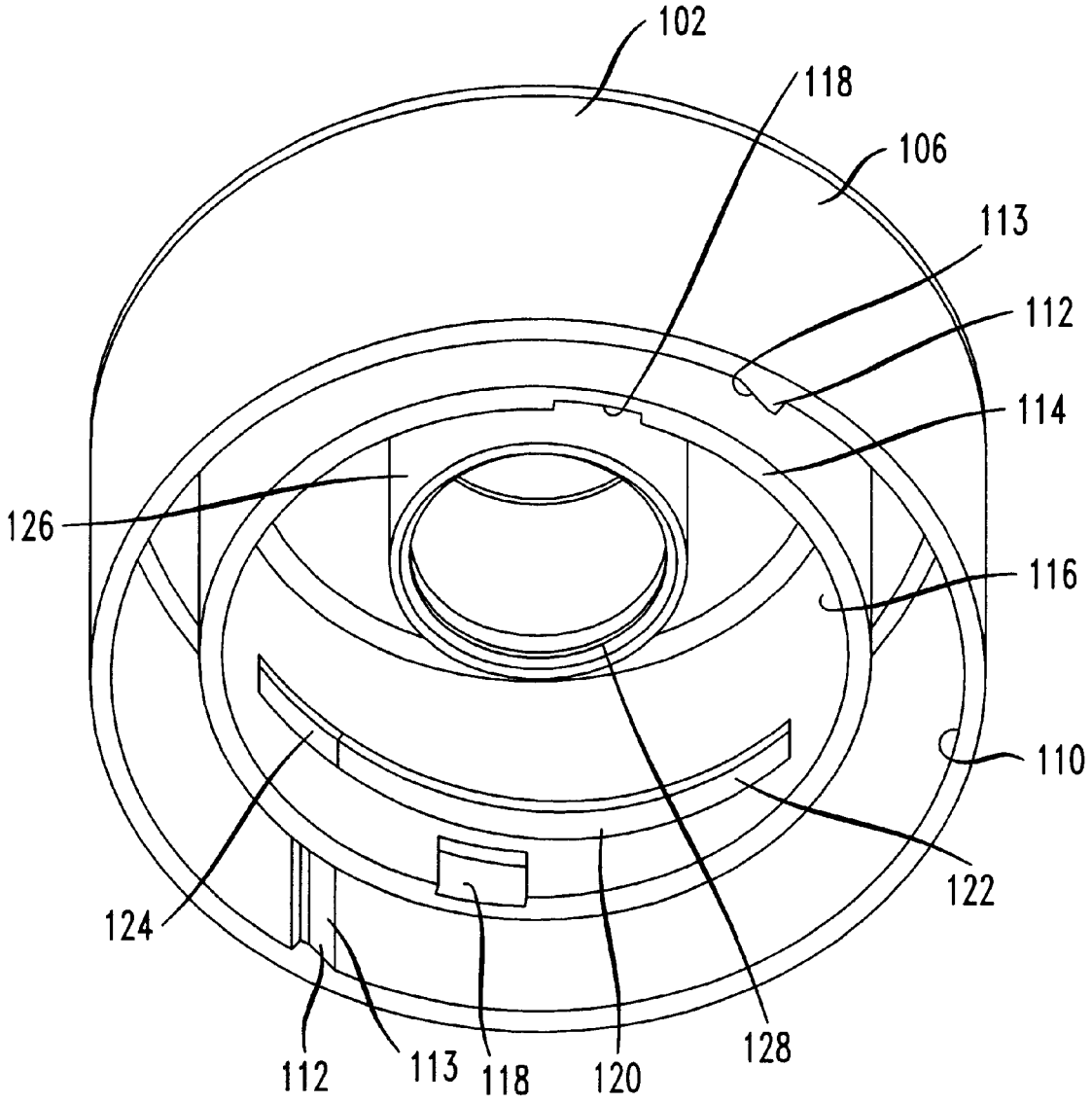
FIG. 10 is a perspective view of the outer shell of the dispenser of FIG. 9.
Figure 11:
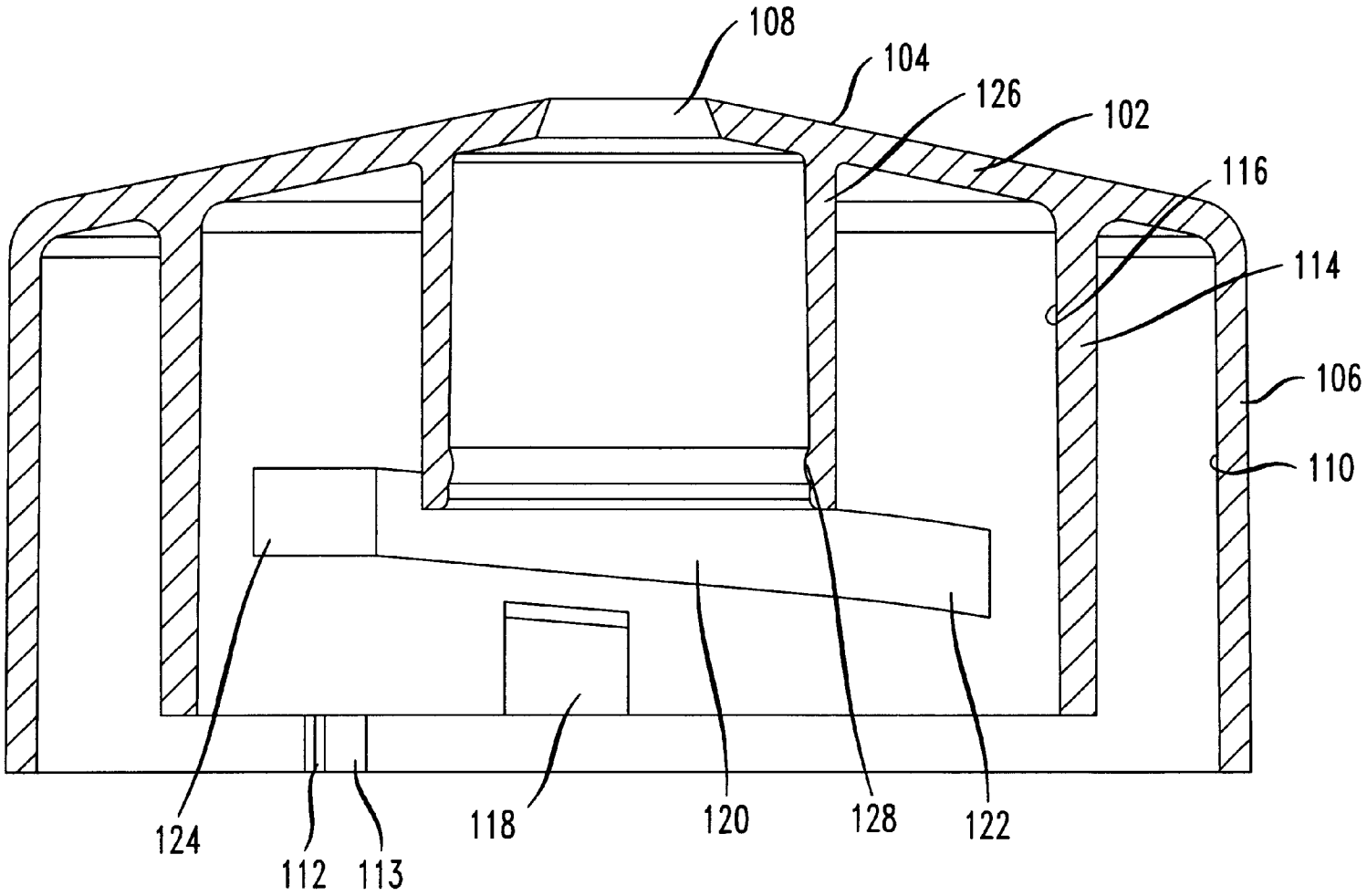
FIG. 11 is a cross-sectional view of the outer shell of the dispenser of FIG. 9.

The outer shell 102 further includes an internal side portion 114 which is generally cylindrical in shape. The internal side portion 114 is completely encircled by the side portion 106. The internal side portion 114 includes an inner surface 116. Located at a lower extent of the inner surface 116 are a pair of notches 118 (FIG. 10). The notches 118 function to receive lugs 138 during assembly of the inner shell 130. Further located on inner surface 116 are a pair of sloping races 120. As illustrated in FIG. 11, the race 120 has a first portion 124 and a second portion 122. As shown, the first portion 124 has virtually no slope, while the second portion 122 slopes downwardly away from the first portion 124. Alternatively, the races 120 may be formed of a single portion having a singular slope.

Completely encircled within the internal side portion 114 is a seal peg receiver 126, which itself is generally cylindrical in shape. Located at a lower extent of the seal peg receiver 126 is a lip 128. Lip 128 is a cylindrical seal that mates with innermost outside diameter of 130.

Figure 9:
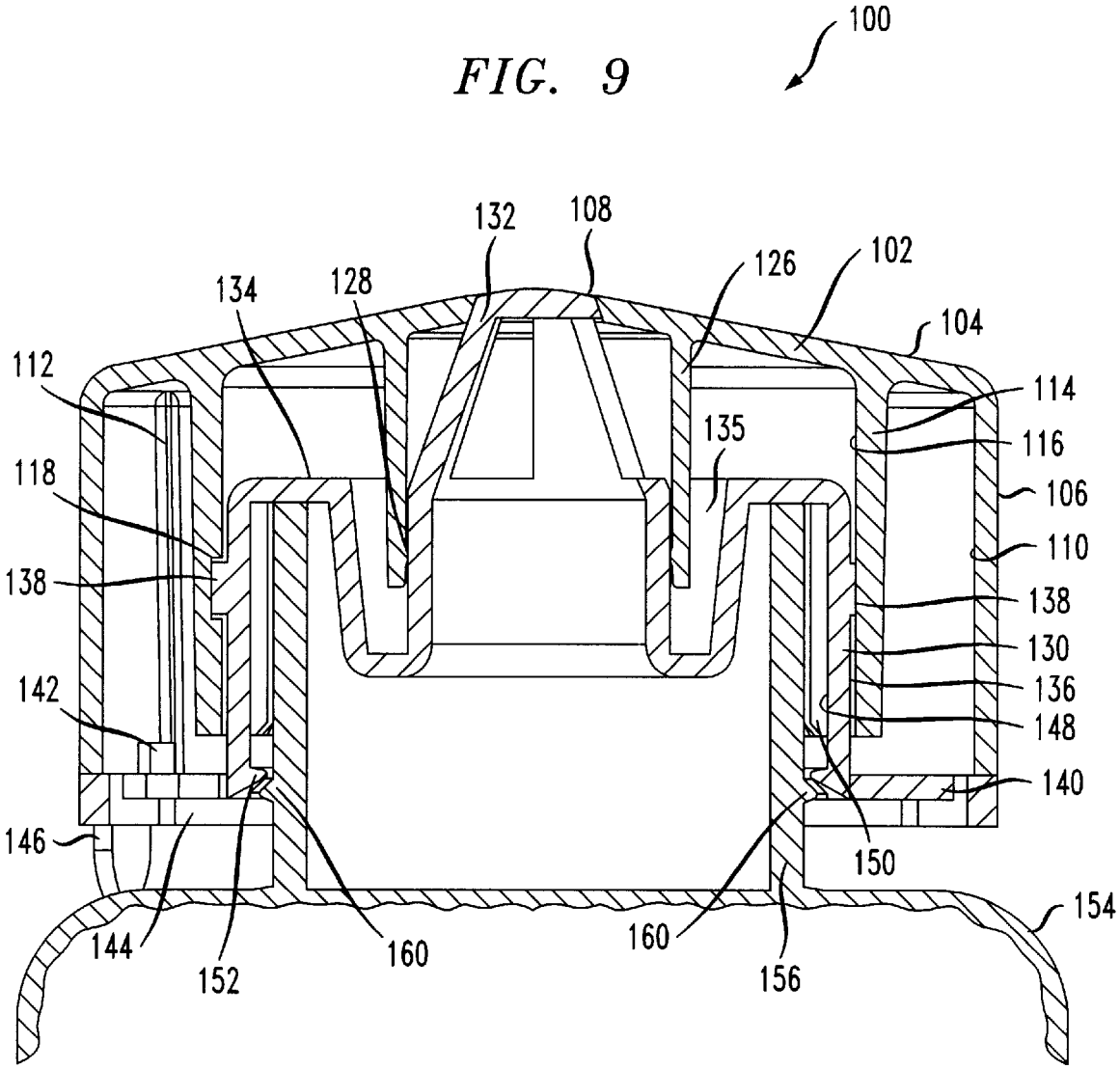
FIG. 9 is a cross-sectional view of a dispenser constructed in accordance with another preferred embodiment of the invention.
Figure 12:
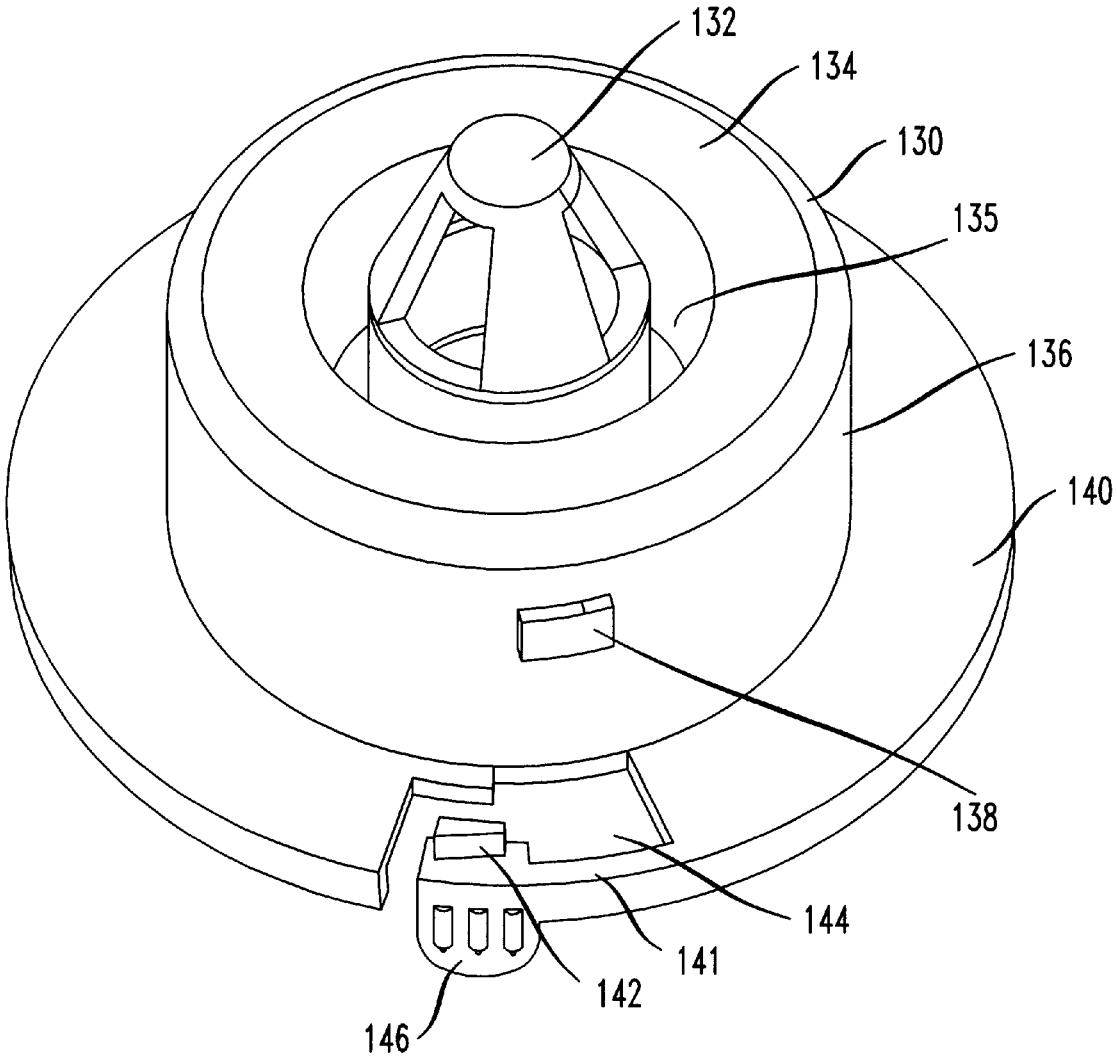
FIG. 12 is a perspective view of the inner shell of the dispenser of FIG. 9.
Figure 13:
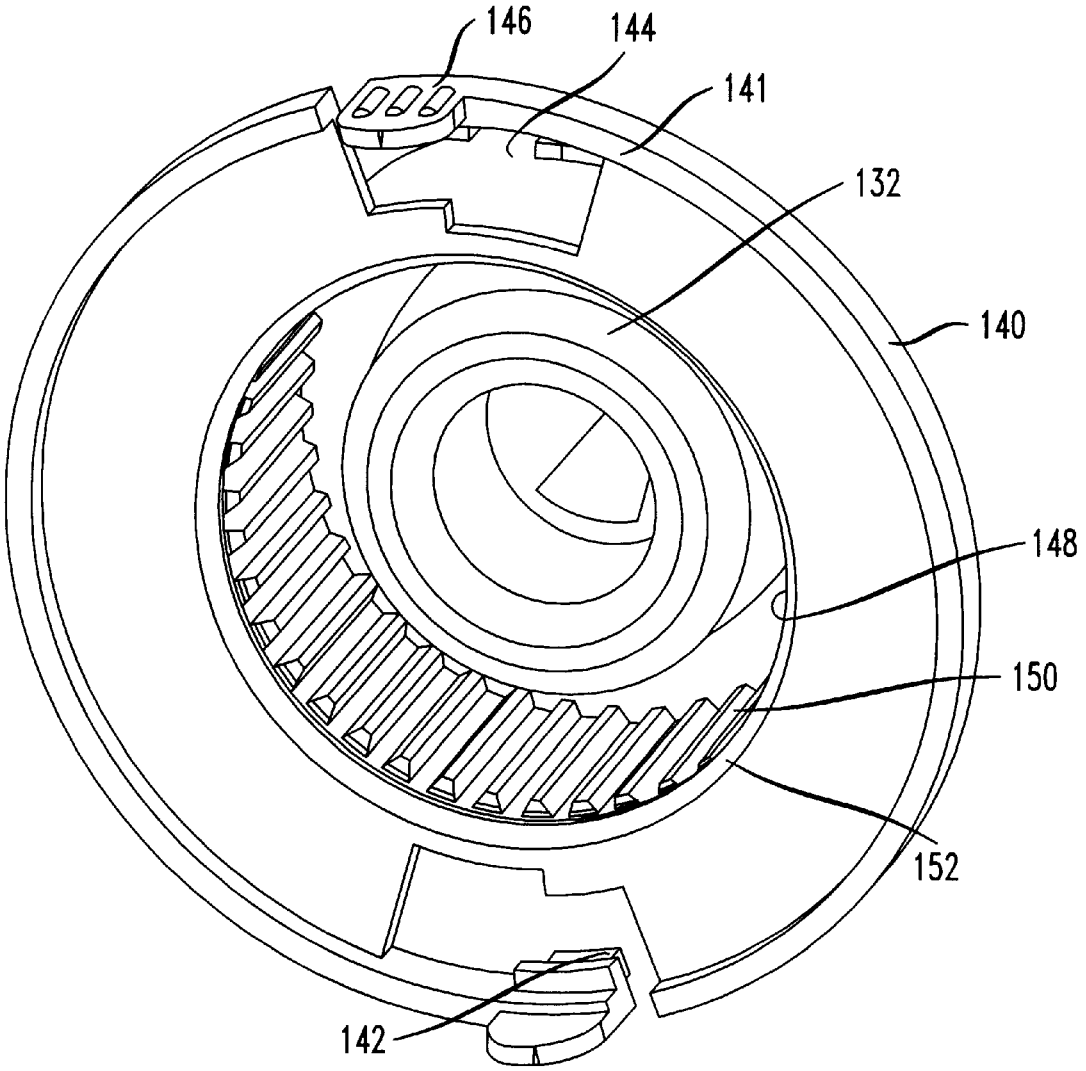
FIG. 13 is another perspective view of the inner shell of the dispenser of FIG. 9.

With particular reference to FIGS. 9, 12, 13, the inner shell 130 includes a seal peg 132 which is received by the seal peg receiver 126. The inner shell 130 further includes a side portion 136 and a top portion 134. The seal peg 132 is separated from the top portion 134 by a well 135. When the seal peg receiver 126 receives the seal peg 132, the seal peg receiver 126 fits down within the well 135 such that the lip 128 encircles a lower extent of the seal peg 132 located in the well 135. This engagement is maintained.

Two or more lugs 138 are located on the side portion 136. The lugs 138 are sized, shaped and positioned to be received within and movable along the races 120. Each of the lugs 138 is equally spaced from the other lugs 138.

Located at a lower extent of the side portion 136, and having a greater diameter thereof, is a base portion 140. The base portion 140 is generally cylindrical in shape and includes a latching mechanism which will now be described. With specific reference to FIGS. 12, 13, the base portion 140 includes a pair of flange members 141. At an end of each flange member 141 is located a thumb tab 146. Extending axially upward from each thumb tab 146 is a latch 142. Each flange member 141 and each tab 146 are located radially outward from an opening 144. The openings 144 permit the flange members 141 to flex radially inwardly to assist in locking (closing) and unlocking (opening) the dispenser 100.

The inner shell side portion 136 includes an inner surface 148. A plurality of axially aligned ridges 150 extend radially along the inner surface 148. Located at a lower extent of the inner surface 148 and below the ridges 150 is a lip 152.

Figure 14:
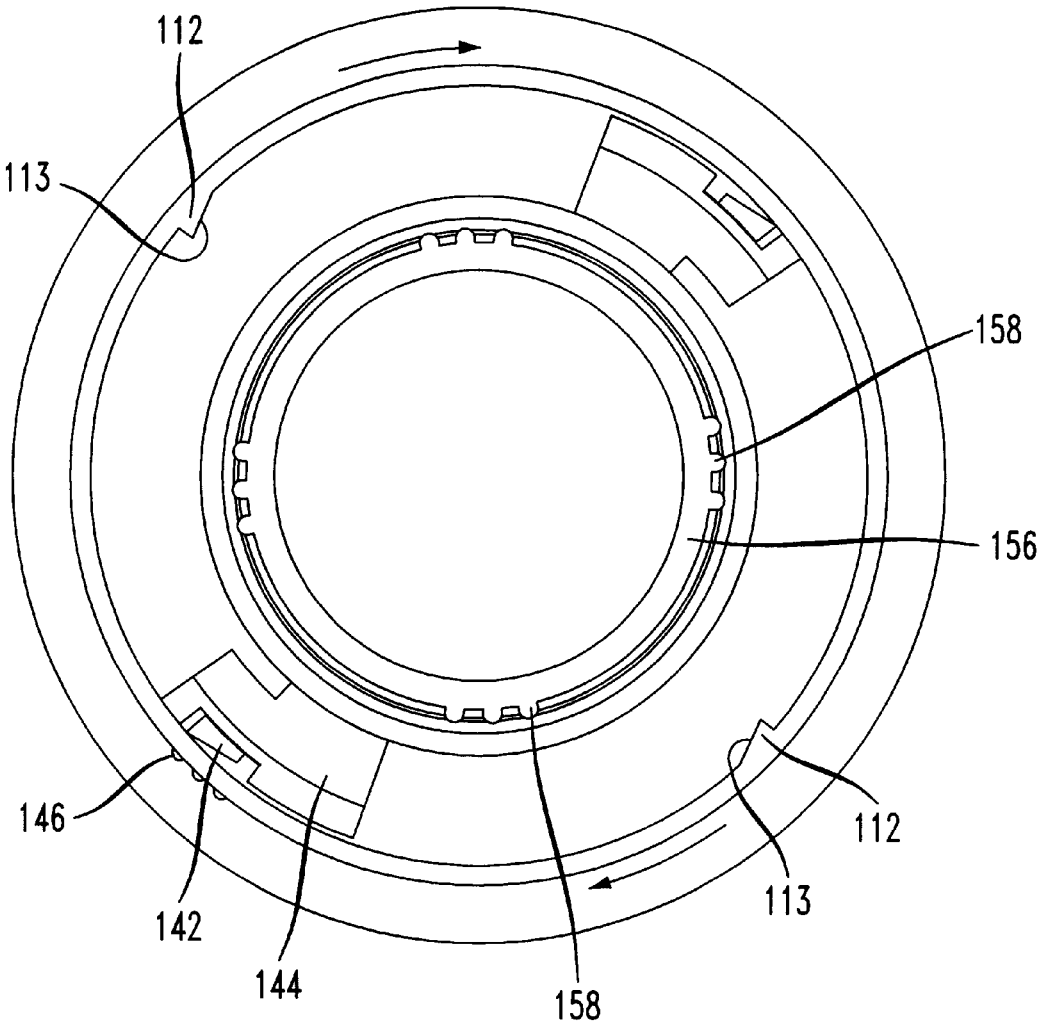
FIG. 14 is a view from the top of the dispenser of FIG. 9 in the opened position.

The inner shell 130 is adapted to receive a container neck 156 of a container 154. With reference to FIGS.9, 14, the container neck 156 includes a plurality of axially aligned ridges 158. Further located on the container neck 156 is a radially extending lip 160. When assembled, the container neck 156 is positioned interior to the inner surface 148 of the inner shell 130. More particularly, the container neck ridges 158 mesh with the ridges 150 on the inner surface 148 of the inner shell 130. Further, the lip 152 on the inner surface 148 of the inner shell 130 is positioned adjacent to the container neck lip 160. The lip 152 moves from the position shown in FIG. 9 above the lip 160 to a position below the lip 160 when the inner shell 140 and outer shell 100 are properly snapped onto the bottle.

Figure 15:
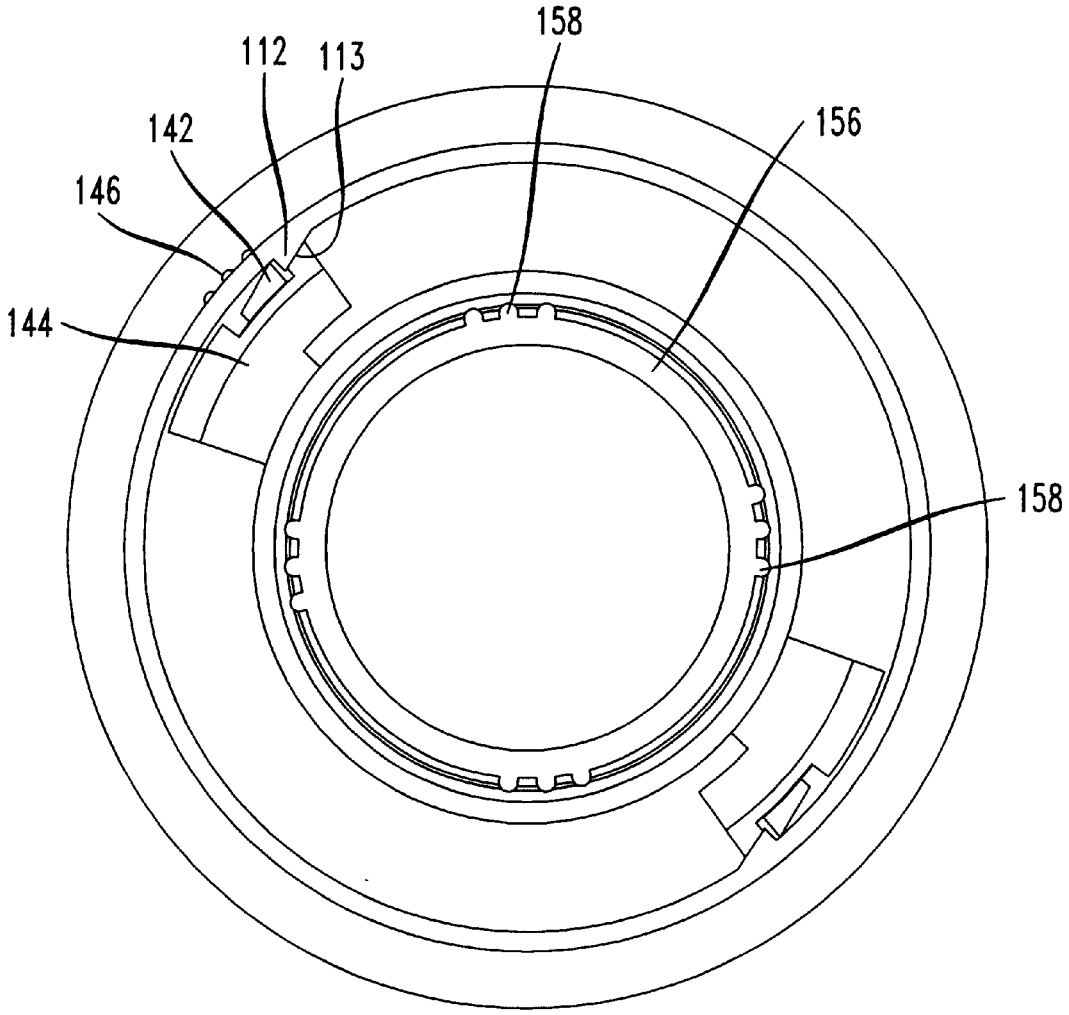
FIG. 15 is a view from the top of the dispenser of FIG. 9 in the closed position.

Next will be described the method of opening and closing (locking) the dispenser 100. With specific reference to FIG. 14, the dispenser 100 is shown in the open position. As illustrated, the latches 112 are a quarter turn (approximately 90 degrees) from each of the latches 142. With reference to FIGS. 14, 15, by rotating the outer shell 102 in the clockwise direction approximately a quarter turn, the latches 112 come in contact with the latches 142. Specifically, the sloping surface 113 of each of the latches 112 comes in contact with and slides over the latches 142. By turning the outer shell 102 just beyond a quarter turn, the latches 112 pass the latches 142, thereby locking, or closing, the dispenser 100. During this closing procedure, the lugs 138, which were positioned at the lowest extent of the second portion 122 move up through the second portion 122 and into the first portion 124. To open, or unlock, the dispenser 100, one places an inwardly directed force on the thumb tab 146. Then, the outer shell 102 is rotated counter-clockwise. The outer shell 102 moves axially upwardly relative to the inner shell 130, resulting in the seal peg 132, which was obstructing the orifice 108, moving axially away from, and thereby opening, the orifice 108.

With reference to FIGS. 16–22, a child resistant dispenser 200 constructed according to another preferred embodiment of the invention is shown. The dispenser 200 includes an outer shell 202 and an inner shell 228. The outer shell 202 is generally cylindrical in shape and includes a top portion 204 and a side portion 208. Extending through the top portion 204 is an orifice 206. A plurality of axially aligned ridges 210 (FIGS. 20, 21) encircle the circumference on the side portion 208. The ridges 210 assist in one's ability to grip and rotate the outer shell 202. Also positioned on the side portion 208 is a thumb tab 212 including a plurality of pads 213. In an alternative embodiment, a second thumb tab 212 may be positioned directly opposite (180 degrees) from the other tab 212.

Figure 16:
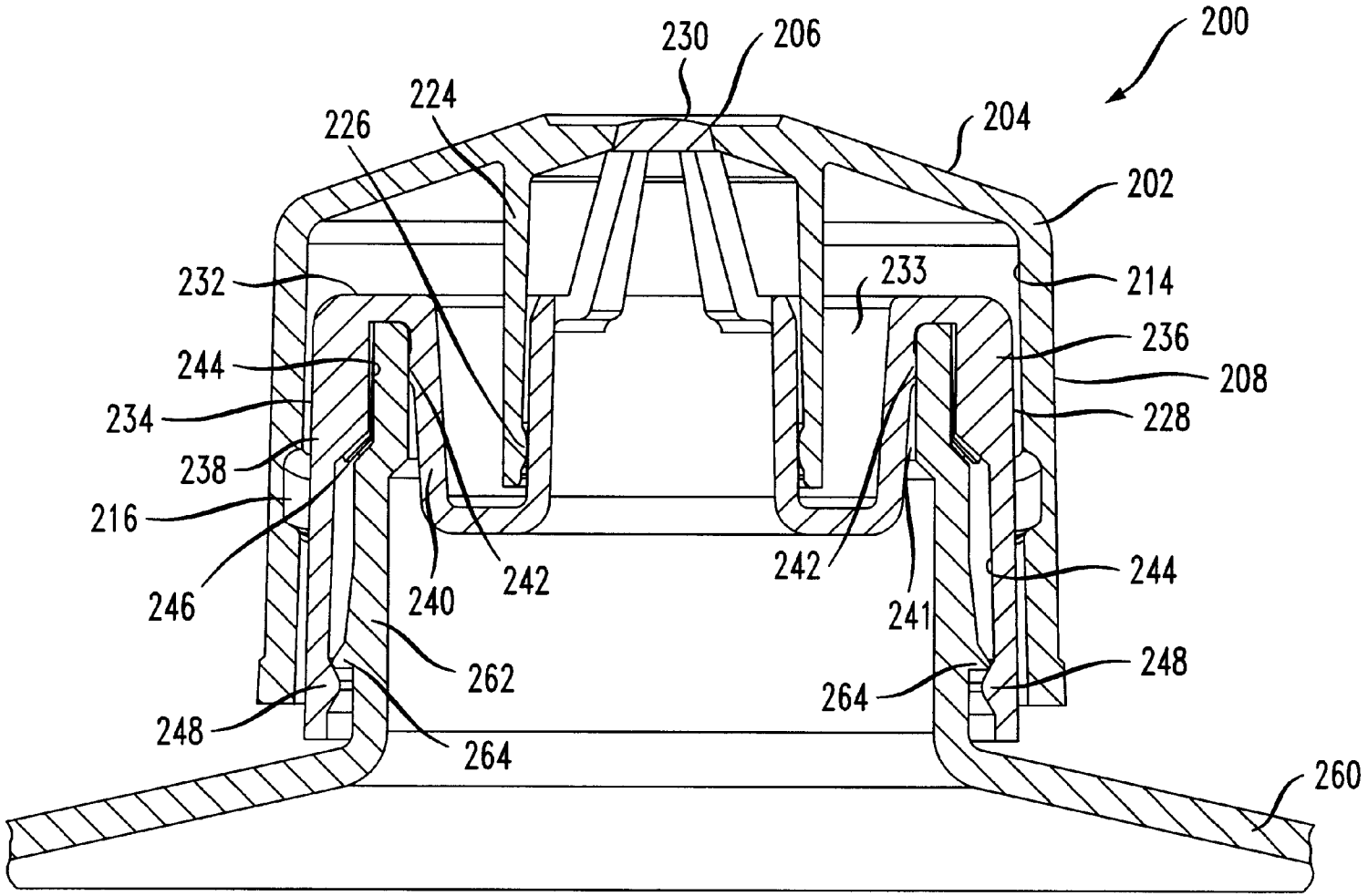
FIG. 16 is a cross-sectional view of a dispenser constructed in accordance with another preferred embodiment of the invention.
Figure 17:
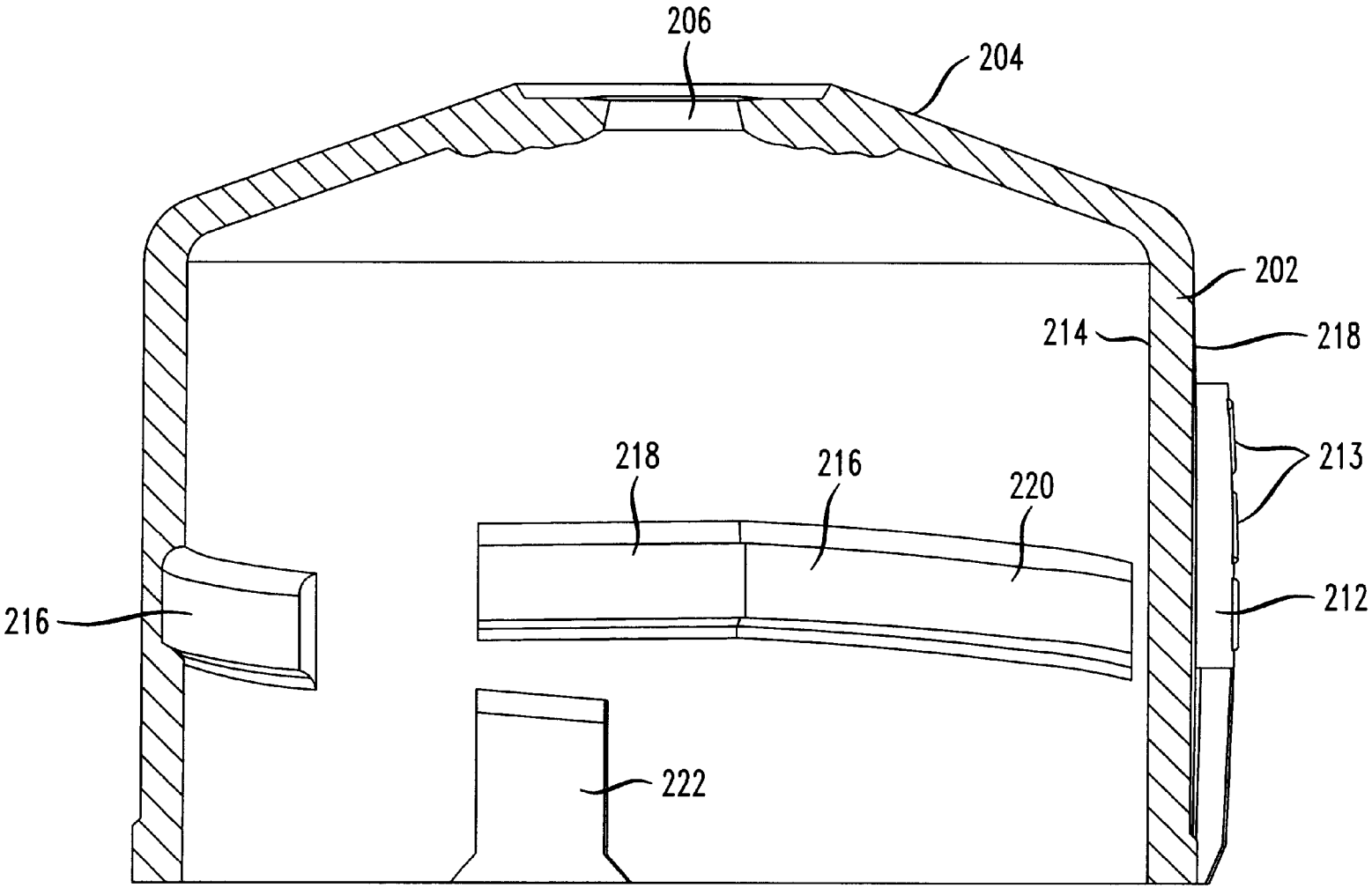
FIG. 17 is a partial cross-sectional view of the outer shell of the dispenser of FIG. 16.

Referring to FIGS. 16, 17, the side portion 208 includes an inner surface 214. Positioned at a lower extent of the inner surface 214 are two or more notches 222. The notches 222 are used for alignment and assembly of the inner shell 228. Further positioned on the inner surface 214 are a plurality of sloping races 216. As shown in FIG. 17, the races 216 include a first portion 218, having virtually no slope, and a second portion 220 sloping downwardly away from the first portion 218. Alternatively, the races 216 may consist of a single portion having a singular slope. Preferably, there are three sets of races 216.

Positioned radially interior to and completely encircled by the side portion 208 is a seal peg receiver 224. The seal peg receiver 224 is generally cylindrical in shape and includes a lip 226 positioned at a lower extent thereof.

The dispenser 200 further includes an inner shell 228 which is positioned radially interior to the outer shell 202. The inner shell 228 includes a seal peg 230, a top portion 232, and a side portion 234. The seal peg 230 is separated from the top portion 232 by a well 233. When assembled, the seal peg 230 is received within the seal peg receiver 224 such that the seal peg receiver 224 extends down into the well 233 and the seal peg receiver lip 226 extends circumferentially around a lower extent of the seal peg 230. This cylindrical seal is maintained throughout the opening and closing movement.

Figure 18:
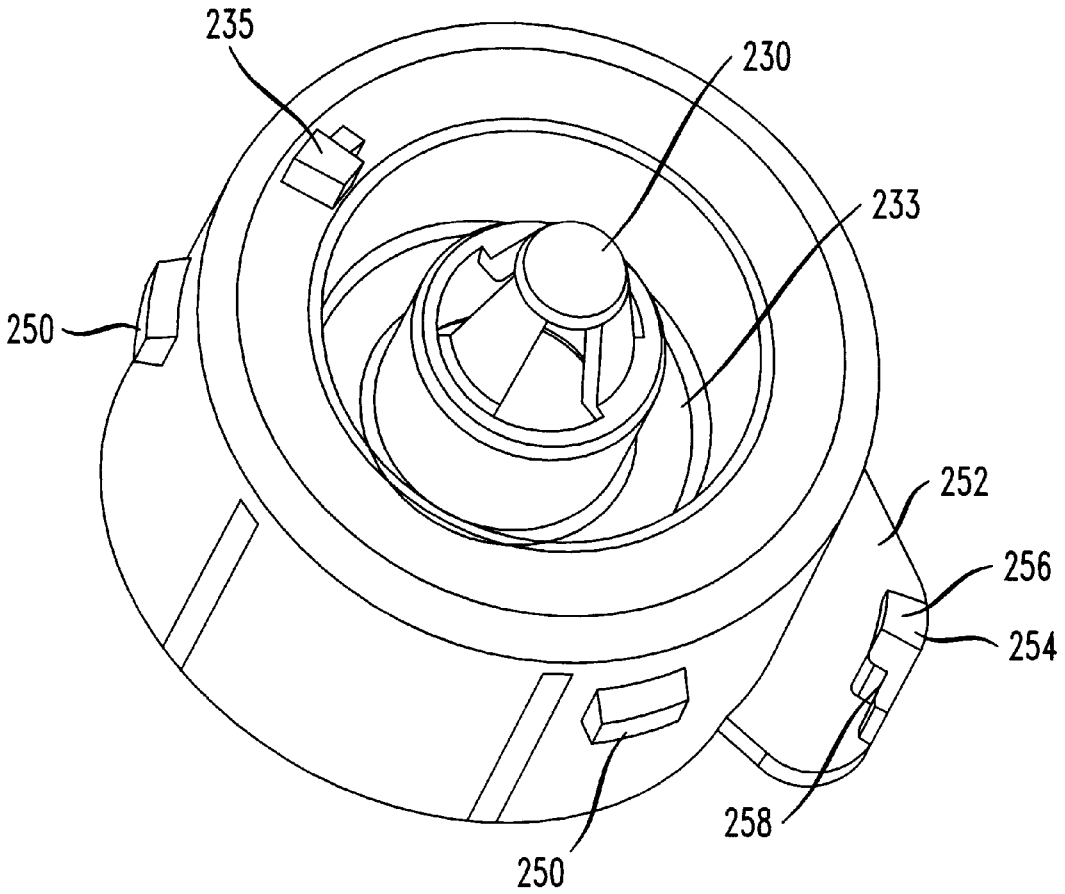
FIG. 18 is a perspective view of the inner shell of the dispenser of FIG. 16.

Located on the top portion 232 is a protrusion 235 (FIG. 18). The protrusion 235 functions as an optional stop, when mating with a corresponding protrusion on an inside surface of the outer shell 202 to eliminate over torque damage.

The inner shell 228 includes an upper segment 236 having an outer portion 238 and an inner portion 240 separated by a well 241. The inner portion 240 includes a lip 242 which extends radially outwardly into the well 241. When assembled (described in greater detail below), a neck 262 of a container 260 fits within the well 241 between the inner portion 240 and the outer portion 238 of the upper segment 236.

Figure 19:
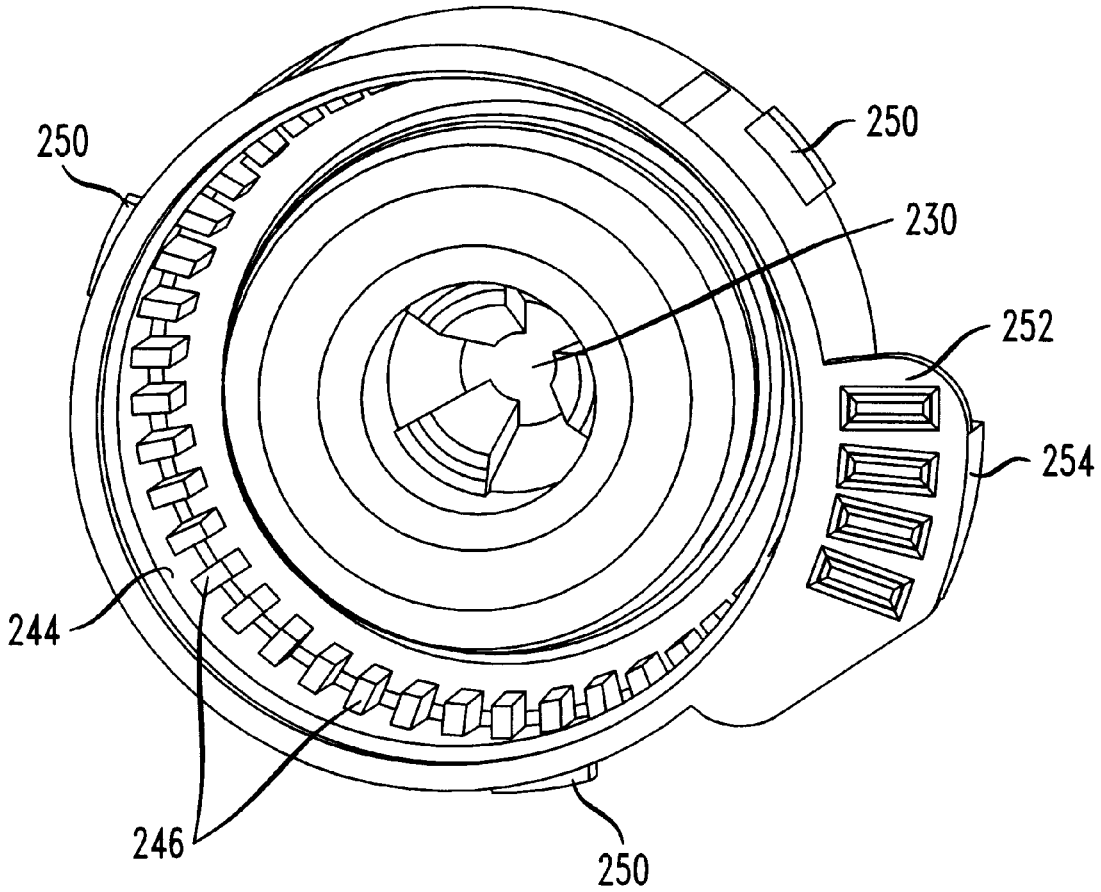
FIG. 19 is another perspective view of the inner shell of the dispenser of FIG. 16.

The inner shell side portion 234 includes an inner surface 244 (FIGS. 16, 19). A plurality of axially aligned ridges 246 extend radially around the circumference of the inner surface 244. Located at a lower extent of the inner surface 244 and positioned below the ridges 246 is a circumferentially extending lip 248.

With reference to FIGS. 18, 19, a plurality of lugs 250 are located on the inner shell side portion 234. Each of the lugs 250 is received within one of the plurality of races 216. Preferably, there arc three lugs 250 to be received by three races 216, and each of the lugs 250 is positioned approximately 120 degrees from the other lugs 250. The plurality of races 216 and lugs 250 provide vertical movement of the outer shell 202 during opening and closing of the dispenser 200. Preferably, there is one lug 250 for each race 216. Most preferably, there are three lugs 250 and races 216.

Positioned at a lower extent of the side portion 234 is a latching segment 252. The segment 252 includes a latch 254. The latch 254 has a main portion 256 including a ramp 257 and an engaging portion 258. The engaging portion 258 engages the thumb tab 212 of the outer shell 202.

Figure 22:
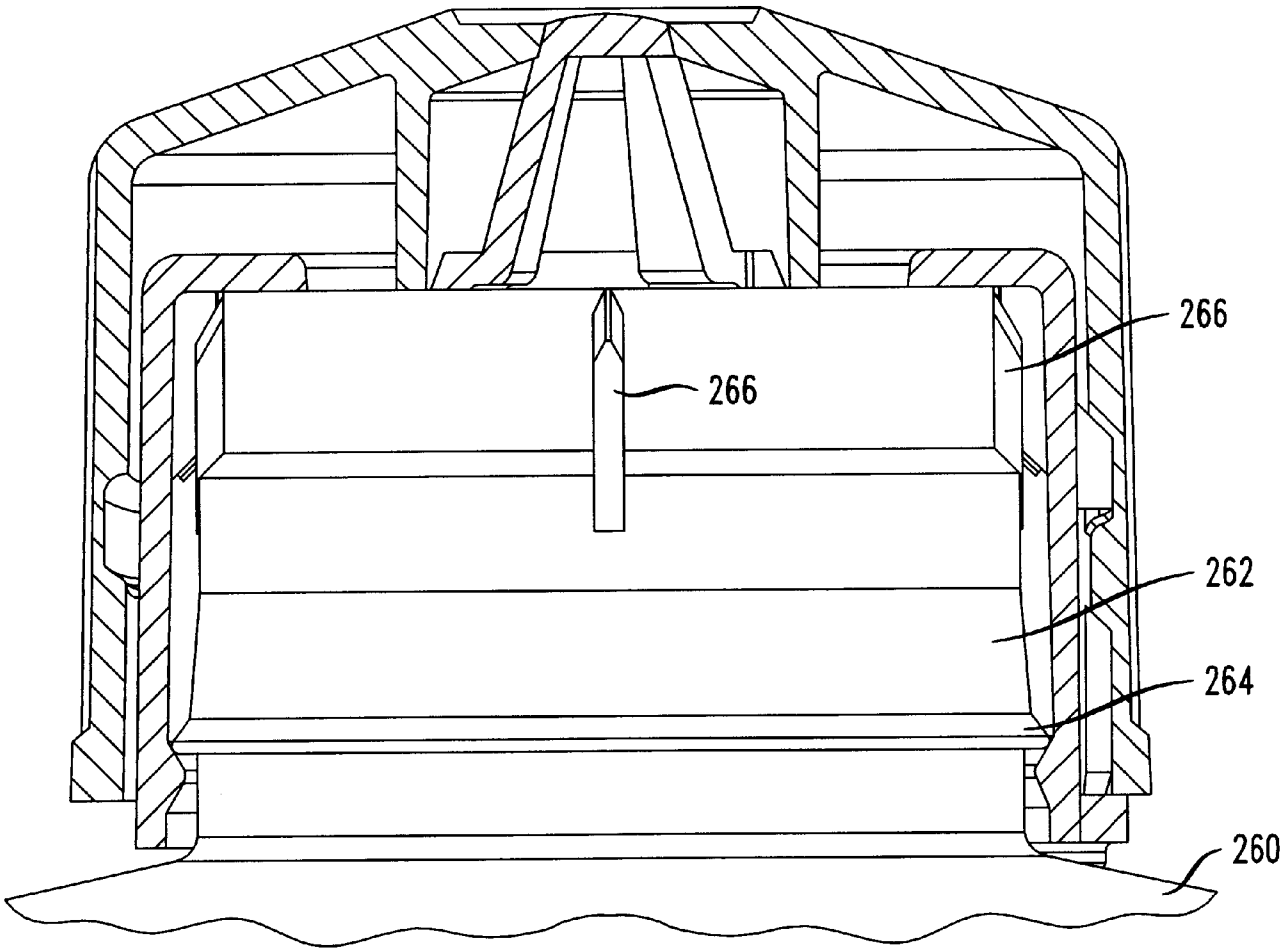
FIG. 22 is a partial cross-sectional view of the dispenser of FIG. 16.

With reference to FIGS. 16, 22, the inner shell 228 is sized and shaped to receive the container neck 262 of the container 260. The container neck 262 includes a plurality of axially aligned ridges 266 as well as a circumferentially extending lip 264. When assembled, the container neck 262 is positioned within the well 241 of the inner shell 228. Further, the container neck ridges 266 mesh with the inner shell ridges 246. Finally, the inner shell lip 248, positioned adjacent to the container neck lip 264, remains below the lip 264 during opening and closing of the dispenser 200.

Figure 20:
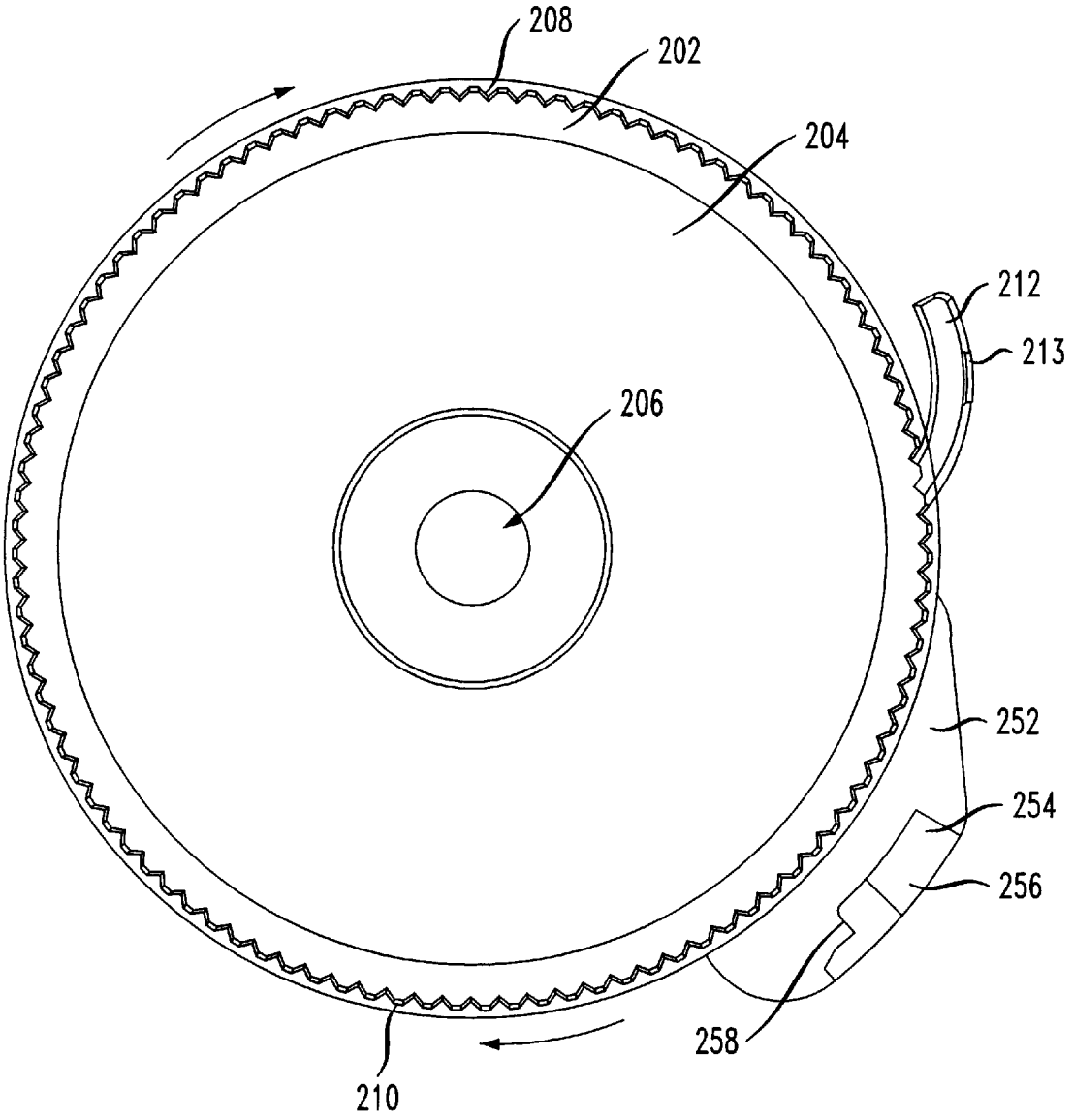
FIG. 20 is a view from the top of the dispenser of FIG. 16 in the opened position.
Figure 21:
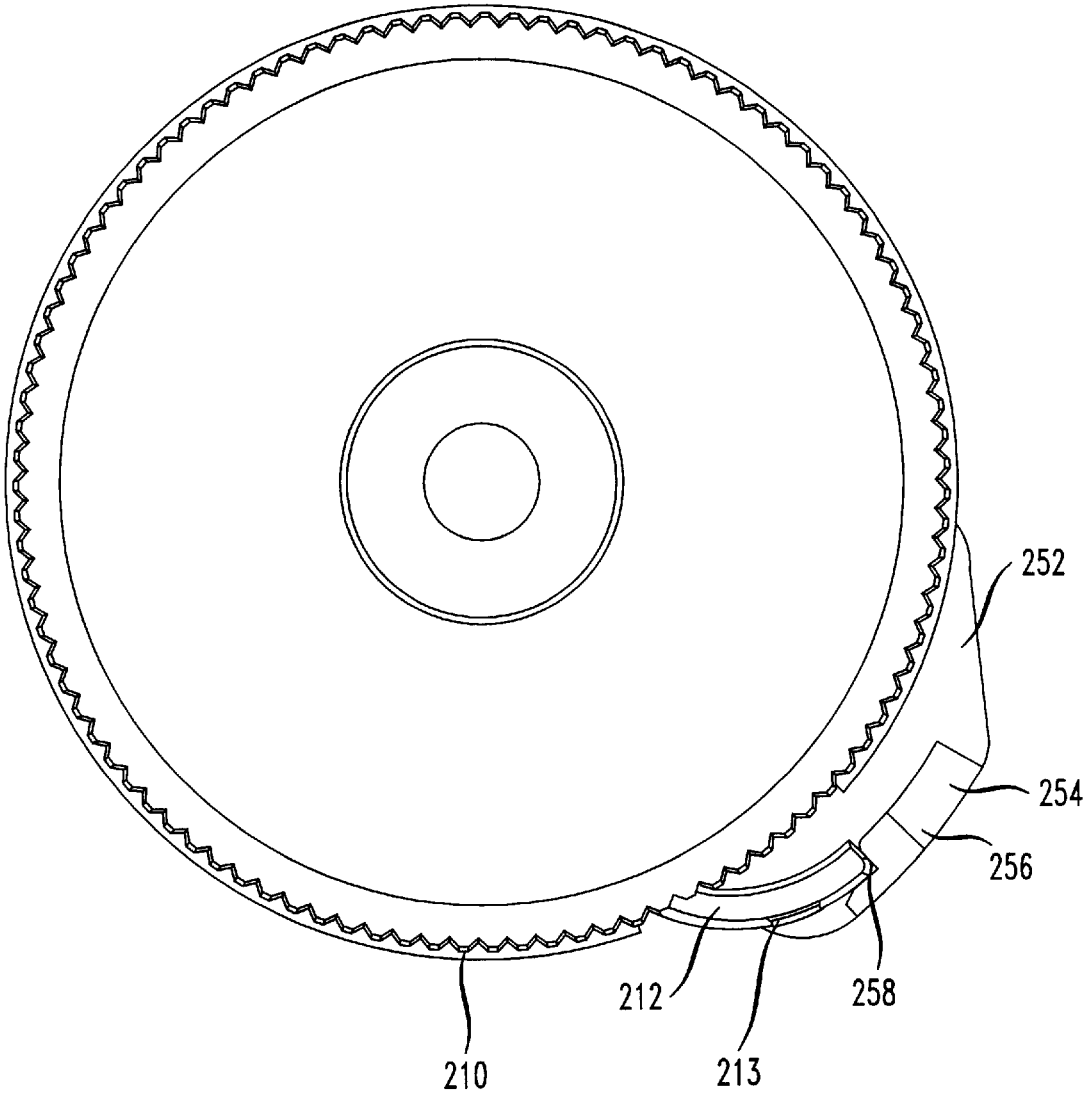
FIG. 21 is a view from the top of the dispenser of FIG. 16 in the closed position.

Next will be described a method of opening and closing (locking) the dispenser 200. With reference to FIG. 20, dispenser 200 is shown in the open position. In this position, the seal peg 230 is positioned such that it does not obstruct the orifice 206 of the outer shell 202. Further, the thumb tab 212 is not engaged with the latch 254. In this position, the lugs 250 are at the lowest extent of the second portions 220 of the sloping races 216. To close, or lock, the dispenser 200, the thumb tab 212 flexes inwardly from contact with the ramp 257 of the latch main portion 256 as the outer shell 202 is rotated in a clockwise direction. The thumb tab 212 moves beyond the latch main portion 256 and flexes radially outwardly to engage with the latch engaging portion 258. Please note, with reference to FIG. 17, that the thumb tab 212 extends axially above the latch 254, thus enabling one to easily rotate the outer shell 202 without becoming encumbered in the latch 254. In the closed position, the seal peg 230 obstructs the orifice 206 (FIGS. 16, 22), and the lugs 250 are located in the first portions 218 of the races 216. During the opening process, the lugs 250 move downwardly from the first portions 218 into the second portions 220, thereby moving the outer shell 202 axially upward relative to the inner shell 228.

What is claimed as new and desired to be protected by letters patent of the United States is:

1. A dispenser, comprising:

an outer shell, including:

a top portion having a spout with an orifice extending therethrough;

a side portion having an inner surface, wherein at least one latch is located on said inner surface;

an interior side portion, said interior side portion having an inner surface, wherein at least one sloping race is located on said interior side portion inner surface; and a seal peg receiver; and an inner shell, including:

a seal peg;

a top portion; and a side portion having at least one lug, at least one stop, and an inner surface, said inner surface being sized and shaped to receive a neck of a container;

wherein said seal peg is movably received within said seal peg receiver, said at least one lug is movably received within said at least one race, and said at least one latch and said at least one stop are sized and positioned to engage each other and to permit rotatable opening and closing of the dispenser.

2. The dispenser of claim 1, wherein said at least one race has at least two portions, each said portion having a different slope.

3. The dispenser of claim 2, wherein one said race portion has no slope.

4. The dispenser of claim 2, including two latches and two stops, and two races and two lugs.

5. The dispenser of claim 4, further including a pair of tabs on said outer shell side portion, wherein a radially inwardly directed force exerted on said tabs enables disengagement of said latches from said stops.

6. The dispenser of claim 5, wherein while said latches are disengaged from said stops, a counter-clockwise rotation of said outer shell moves said lugs along said races and axially moves said seal peg away from said orifice, thereby opening the dispenser.

7. The dispenser of claim 6, wherein a clockwise rotation of said outer shell moves said lugs along said races, axially moves said seal peg toward said orifice, and engages said latches with said stops, thereby closing the dispenser.

8. A dispenser, comprising:

an outer shell, including:

a top portion with an orifice extending therethrough;

a side portion having an inner surface, wherein at least one latch is located on said inner surface;

an interior side portion, said interior side portion having an inner surface, wherein at least one sloping race is located on said interior side portion inner surface; and a seal peg receiver; and an inner shell, including:

a seal peg;

a top portion;

a side portion having at least one lug and an inner surface, said inner surface being sized and shaped to receive a neck of a container; and a base portion having a pair of finger tabs and a pair of latches;

wherein said seal peg is movably received within said seal peg receiver, said at least one lug is movably received within said at least one race, and said base portion latches are engageable and disengageable with said outer shell latches to permit rotatable opening and closing of the dispenser.

9. The dispenser of claim 8, wherein said at least one race has at least two portions, each said portion having a different slope.

10. The dispenser of claim 9, wherein one portion of all races has no slope.

11. The dispenser of claim 10, wherein a radially inwardly directed force exerted on said tabs enables disengagement of said base portion latches from said outer shell latches.

12. The dispenser of claim 11, wherein while said base portion latches are disengaged from said outer shell latches, a counter-clockwise rotation of said outer shell moves said lugs along said races and axially moves said seal peg away from said orifice, thereby opening the dispenser.

13. The dispenser of claim 12, wherein a clockwise rotation of said outer shell moves said lugs along said races, axially moves said orifice toward said seal peg, and engages said base portion latches with said outer shell latches, thereby closing the dispenser.

14. The dispenser of claim 8, further including a pair of openings on said base portion located radially interior to said tabs.

15. A dispenser, comprising:

an outer shell, including:

a top portion with an orifice extending therethrough;

a side portion having a flexible thumb tab and an inner surface, wherein at least one sloping race is located on said inner surface; and a seal peg receiver; and an inner shell, including:

a seal peg;

a top portion;

a side portion having at least one lug and an inner surface, said inner surface being sized and shaped to receive a neck of a container; and a base portion having a latch;

wherein said seal peg is movably received within said seal peg receiver, said at least one lug is movably received within said at least one race, and said base portion latch is engageable and disengageable with said thumb tab to permit rotatable opening and closing of the dispenser.

16. The dispenser of claim 15, wherein said at least one race has at least two portions, each said portion having a different slope.

17. The dispenser of claim 16, wherein one said race portion has no slope.

18. The dispenser of claim 17, including three races and three lugs.

19. The dispenser of claim 18, wherein a radially inwardly directed force exerted on said tab enables disengagement of said base portion latch from said tab.

20. The dispenser of claim 19, wherein while said base portion latch is disengaged from said tab, a counter-clockwise rotation of said outer shell moves said lugs along said races and axially moves said orifice away from said seal peg, thereby opening the dispenser.

21. The dispenser of claim 20, wherein a clockwise rotation of said outer shell moves said lugs along said races, axially moves said orifice toward said seal peg, and engages said base portion latch with said tab, thereby closing the dispenser.

22. The dispenser of claim 21, wherein said seal peg is separated from said inner shell top portion by a well, said seal peg receiver being received within said well.

23. The dispenser of claim 22, wherein said base portion latch includes a main portion and an engaging portion, said engaging portion engaging with said tab.

* * * * *

UNITED STATES PATENT AND TRADEMARK OFFICE
Certificate

Patent No. 6,065,648 Patented: May 23, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John Tauber, Baltimore, MD; Donald P. Deubel, New Lenox, IL; and William C. Crites, Baltimore, MD.

Signed and Sealed this Sixth Day of January 2004.

GENE MANCENE
*Supervisory Patent Examiner*
Art Unit 3754